United States Patent [19]

Raz

[11] 4,128,906

[45] Dec. 12, 1978

[54] TOILET-BOWL FLUSH SYSTEM AND DEVICES THEREFOR

[76] Inventor: Zeev Raz, 17 Keren Hayessod Str., Be'er-Sheva, Israel

[21] Appl. No.: 812,519

[22] Filed: Jul. 5, 1977

Related U.S. Application Data

[63] Continuation-in-part of Ser. No. 689,055, May 24, 1976, abandoned.

[30] Foreign Application Priority Data

Jun. 15, 1975 [IL] Israel ..... 47481
Feb. 10, 1976 [IL] Israel ..... 49011

[51] Int. Cl.[2] ..... E03D 1/22; E03D 1/36

[52] U.S. Cl. ..... 4/325; 4/340; 4/366

[58] Field of Search ..... 4/1, 18 R, 34, 36, 37, 4/39, 40, 41, 57 R, 57 P, 67 R, 67 A, DIG. 1, 324–326, 340, 345, 346, 353, 363–366, 405, 412–415, 393, 395

[56] References Cited

U.S. PATENT DOCUMENTS

| | | | |
|---|---|---|---|
| 1,323,703 | 12/1919 | Linfoot | 4/37 UX |
| 3,732,577 | 5/1973 | Moon | 4/18 R |
| 3,766,571 | 10/1973 | Elder | 4/67 A X |
| 3,823,425 | 7/1974 | Coffman | 4/67 A X |
| 3,842,444 | 10/1974 | Gruenhagen | 4/67 A |
| 4,038,708 | 8/1977 | Perrine et al. | 4/67 A |

*Primary Examiner*—Stuart S. Levy
*Attorney, Agent, or Firm*—Holman & Stern

[57] ABSTRACT

The invention provides a device for converting a single volume cistern into a selective volume cistern adapted to selectively allow both low volume and high volume flushes wherein the single volume-cistern is of the type having a water inlet, a water outlet, a valve mechanism operationally linked to a float lever arrangement for controlling the amount of water flowing into the cistern, a flush actuating means and a flushing mechanism operationally linked to said water outlet, said device comprising a hollow vessel provided with an opening at its upper end for the entry of water therethrough and being adapted to be inserted into the flushing cistern in a first normally closed rest position which at least partially surrounds the flushing mechanism and forms an open ended water column extending above and around said water outlet to exclude a portion of the water in said cistern from passing through said water outlet while said vessel is in said first position for low volume flushes and wherein at least a section of the upwardly extending surface area of said vessel is adapted to be tilted and pivotally displaced from said first rest position to a second displaced open-position to form a multi-directional opening for the rapid passage of water under the lower edge of said tiltable section, a portion of said tiltable section being adapted in its displaced position to intersect the arc ascribed by a water level responsive float means whereby said portion is adapted to be engaged by said float means in its downward arc upon the emptying of the cistern and to be retained in said displaced position during the entire flushing action and until the completion thereof whereafter the rising water in the refilling cistern lifts said float means away from said section and allows said section to automatically return to its initial closed rest position.

16 Claims, 6 Drawing Figures

TOILET-BOWL FLUSH SYSTEM AND DEVICES THEREFOR

This application is a continuation-in-part of an application entitled Toilet-bowl flush system and devices therefor, Ser. No. 689,055 filed May 24, 1976 now abandoned.

The present invention relates to a selective toilet flushing arrangement and more particularly to a device for converting a single-volume flushing cistern into a selective volume flushing cistern adapted to selectively allow both low-volume and high volume flushes.

Single-volume flushing cisterns known today have various mechanisms. There are manufactured and used, for example, in Israel today, flushing cisterns based on the siphon principle and cisterns having an outlet provided with a flushing valve including a seat and a valve member engageable with said seat and liftable therefrom wherein said valve is of the type utilizing an air bell, a buoyant ball valve or a rubber suction cup attachable to the lid of the cistern by vacuum pressure.

All of the above types of toilet flushing arrangements and others known in the art work in their various ways to achieve the same result upon actuation of their respective flushing mechanisms. As is known, upon actuation, the flushing mechanism of a water toilet is arranged to release a predetermined amount of water from the water cistern, which water rushes into the toilet bowl under the force of gravity and flushes waste materials contained in the bowl over a barrier into a discharge conduit that conducts them into a sewer. The amount of water consumed with each such flushing operation is usually substantial.

The common type of cistern contains not less than 6.5 liters of water (the Israeli standard is 9.5±0.5 liters) and on pressing a lever, pulling or pressing a knob, a lever is actuated which releases all the quantity of water in the cistern at once into the toilet bowl. The mechanism and its activating lever have a single-stage action and release the whole quantity of water contained in the cistern at each activation. Frequently, however, the amount of waste in a toilet bowl is very small and in fact in the majority of instances the only waste in the toilet bowl is liquid urine waste. Obviously on such instances it is unnecessary and wasteful to expend at least 6.5 to 9.5 liters, and even up to 5 gallons in larger American type cisterns, to flush liquid waste material from a toilet bowl especially in areas where water is in short supply.

With the increasing shortage of water in almost every country and especially in light of the increased awareness of the public with regard to the importance of the conservation of national resources such as water, people have sought, and means have been suggested, to reduce the quantity of water used in the flushing operation in general and the quantity of water used for flushing down liquids in particular. Thus, for example, in some of the current flushing cisterns, when the user does not press the lever all the way, only a small portion of the water and not all the water in the cistern is released, and there are those who customarily release only a portion of the water in this way when flushing urine. This arrangement was not considered in the planning or the production of the flushing cistern and it is not efficient because the amount of water released by the partial activation is not fixed or regulated and if the user is not sufficiently agile the whole quantity of water is released. Moreover, it has the disadvantage that the user must keep his hand on the lever and wait until the desired quantity has been dispensed.

Some of the means suggested to reduce the amount of water used in general in the flushing operation are exemplified in the descriptions found in U.S. Pat. Nos. 3,259,918 and 3,732,577 in which there are described cup or box-like vessels adapted to surround the flush valve in a conventional cistern forming an open-ended water column extending upward around the valve assembly thereby preventing water stored in the base of the cistern outside the column and below the level of the upper edge or lip thereof from being discharged during flushing. These devices are mainly designed for the American type cisterns which hold up to 5 gallons of water in order to reduce the excessive amount of water used during every flush and are not useful for the European and Israeli cisterns which initially are designed to hold the minimum amount of water calculated by the regulating authorities of the respective countries to be necessary to properly and completely flush solid waste. Furthermore, said devices, once installed, are not designed to allow selective flushing and in fact deliver a uniform reduced amount of water for every flush whether it be for solid or liquid waste.

Dual or selective flushing cisterns have been described in the prior art, e.g., in U.S. Pat. Nos. 2,351,672; 2,731,647; 2,864,095; 3,758,893 and 3,766,571. These patents, however, all operate on the same principle which involves replacing or substantially modifying the existing valve mechanism with a new and usually complicated and expensive two-level selective volume valve assembly for providing optional light and heavy flushes.

In contradistinction to the devices of said prior art patents and in accordance with the present invention there is now provided a simple inexpensive device which permits the conversion of an existing flushing cistern with a single-volume flush mechanism into a selective volume flush unit without introducing any alternations into the single flush valve mechanism itself. One of the major advantages of the devices of the present invention is that they are adapted to be simply installed by the average home owner himself without the need for professional help or expensive tools whereafter said device will act in concert with the existing flush mechanism to achieve the desired results.

Two prior art patents describe devices which proport to have a similar object and approach as the present invention but which have also been found not to achieve the desired results.

In U.S. Pat. No. 3,842,444 there is described and claimed an apparatus for selectively producing a high volume flush or a low volume flush which apparatus comprises barrier means comprising a vertically extending water imprevious sleeve for surrounding a flush ball valve and sealing against the bottom of said tank excluding a portion of the water in the water tank from passing through said flush ball valve wherein said barrier means is buoyant when immersed in water, support means for permitting limited guided vertical movement of said barrier under the influence of the buoyancy of said barrier to lift said barrier out of sealing engagement with the bottom of said tank and permitting substantially all of the water in said tank above the level of said valve to pass under said barrier and through said valve, and latch means on said barrier for releasably securing said barrier in said sealing position. Similarly in U.S. Pat. No. 3,041,630 there is described and claimed a different form of device embodying a water closet valve comprising a basically cylindrical open-ended housing having one end thereof disposed on the bottom of a water closet tank and surrounding the flush valve seat therein in substantialy concentric spaced relation thereto, the said housing being disposed vertically upward therefrom to a height less than the normal full level of the tank in condition for flushing, a flushing level positioned above the upper extremity of the said housing within the said water closet tank and communicating with a flushing handle mounted exteriorly of the said tank, a buoyant ball valve aligned with the said flush valve seat and being concentrically disposed within the said housing, a resilient mounting communicating with the said buoyant ball valve and having its uppermost extremity mounted on the flushing lever, and a gate valve pivotally mounted proximate the lower extremity of the said housing and opening inwardly thereinto.

As is recognized in the art one of the major problems involved is producing a selective volume flushing cistern is that of finding suitable means for effecting the timely opening and the timely and automatic closing of the openable port which is opened to allow the complete discharge of water from the cistern.

Thus, e.g., while U.S. Pat. No. 1,323,703 from 1919 describes a supplemental open-ended chamber adapted to normally rest on the bottom of a tank and to selectively be lifted therefrom to allow full and half flushes, said chamber is moved from one fixed position to another by a manually operated handle and set at either the full or half position while it is preferrable to have an automatic return to a half position to assume greater use thereof.

In both U.S. Pat. Nos. 3,842,444 and 3,041,630 automatic means for closing the openable port, i.e., to close the gate valve or lower the barrier are described, however in both of the above patents the preferred embodiments described, and in fact the only means described for effecting the automatic closing of the openable port, involve the lowering of the barrier in U.S. Pat. No. 3,842,444 and the closing of the gate valve in U.S. Pat. No. 3,041,630 as a direct result of the automatic descent of an auxiliary bouyant float or of the buoyant float of the flushing mechanism respectively.

Systems of the above type wherein the openable port is closed as a direct result of the descent of the flushing mechanism float or of an auxiliary float have now been found to suffer from the disadvantage of having the openable port prematurely begin to close before substantially all the water has exited from the cistern. This premature partial closing of the openable port results in the restriction of the flow rate of the final portion of water below that necessary to achieve the final surge of water which very often is instrumental in properly and completely flushing all of the solid wastes contained in the toilet bowl over the barrier and into the discharge conduit.

Similarly this inter-dependency of the openable port and a flushing mechanism or auxiliary float often results in a premature substantially complete closing of the openable port before substantially all the water has exited from the cistern and the non-utilization of said remaining water in the flushing process.

It is an object of the present invention to provide a device for converting a single-volume flushing cistern into a selective volume flushing cistern wherein during the high-volume discharge of water from the cistern the water exits at a substantially constant discharge rate and volume which will not fluctuate from use to use and which is not influenced by the descent of the water level during the flushing action. Another object of the present invention is to provide a simple and inexpensive device which is easily installable and which does not require any special locking latches or bars to effect the closing of its openable port.

Thus in accordance with the present invention there is now provided a device for converting a single volume cistern into a selective volume cistern adapted to selectively allow both low-volume and high-volume flushes wherein said single volume-cistern is of the type having a water inlet, a water outlet, a valve mechanism operationally linked to a float lever arrangement for controlling the amount of water flowing into the cistern, a flush actuating means and a flushing mechanism operationally linked to said water outlet, said device comprising a hollow vessel provided with an opening at its upper end for the entry of water therethrough and being adapted to be inserted into the flushing cistern in a first normally closed rest position which at least partially surrounds the flushing mechanism and forms an open ended water column extending above and around said water outlet to exclude a portion of the water in said cistern from passing through said water outlet while said vessel is in said first position for low-volume flushes, and wherein at least a section of the upwardly extending surface area of said vessel is adapted to be tilted and pivotally displaced from said first rest position to a second displaced open-position to form a multidirectional opening for the rapid passage of water under the lower edge of said tiltable section, a portion of said tiltable section being adapted in its displaced position to interesect the arc ascribed by a water level responsive float means whereby said portion is adapted to be engaged by said float means in its downward arc upon the emptying of the cistern and to be retained in said displaced position during the entire flushing action and until the completion thereof whereafter the rising water in the refilling cistern lifts said float means away from said section and allows said section to automatically return to its initial closed rest position.

As has been found and will be described hereinafter with reference to the drawings, the provision of a vessel which is adapted to tilt in part or in whole to form a multidirectional opening for the rapid passage of water under the lower edge or edges of the tilted section has many advantages with regard to reliability and simplicity of operation heretofor unachievable with prior art devices. Among these advantages are the fact that a tilted body is much more easily displaced, retained and controlled than a vertically lifted one and is much more readily aligned to return exactly to its original position by attachment to fixed hinges than in a partially or completely buoyant liftable body.

The vessel according to the present invention is mounted in such a way that the lower part of the valve mechanism, or the lower part of the suction section in case of a siphon mechanism, which as is known has no valve, will be functionally surrounded by the vessel. By selective use of the device the user is able, at will, with the aid of the vessel, to fool the flushing mechanism into assuming that the water has already left the flushing cistern and thereby to cause the automatic stopping of any further emptying of the cistern when in fact only the water above and in the vessel have been utilized as will be explained more fully hereinafter.

In the preferred embodiment designed and adapted for use with Israeli and European cisterns of relatively small capacity the devices preferably comprise a hollow vessel insertable into the flushing cistern and adapted to normally rest on the bottom of said cistern wherein the tilting of said section and actuation of the flushing mechanism results in the utilization of substantially all the water contained in the cistern as well as the water enclosed in the vessel for the flushing action and with reference to which arrangement the term high volume flushes relates to substantially complete flushing.

On the other hand while devices of the present invention are normally adapted to rest on the bottom of the cistern, they can obviously be installed in the larger capacity U.S. type cisterns atop the cup or box-like vessels of the type exemplified in U.S. Pat. Nos. 3,259,918 and 3,732,577 described hereinbefore to allow both partial and complete flushes of the water stored in the cistern above the level of the upper edge or lip of the column formed by said cup or box-like vessel which upper edge or lip form and constitute the effective water outlet of the cistern as far as the device of the present invention is concerned.

In such an arrangement and as will be described more fully hereinafter the term high-volume flushes relates to the utilization substantially of only the water within said cup or box-like vessel and the water above the upper edge thereof while the term low volume flush relates to the utilization of the water within said cup or box-like vessel, the water within the hollow vessel of the present invention and the water contained in the cistern above the level of the opening at the upper end of the tiltable vessel of the present invention.

It will be understood that manufacturers can readily produce cisterns having the devices of the present invention installed therein and the present invention is also directed to a flushing cistern whenever provided with a device according to the present invention.

In the devices according to the present invention it is preferred that at least a quarter of the upwardly extending surface area of said vessel be adapted to be tilted and especially preferred are devices wherein at least a third of the upwardly extending surface area of said vessel is adpated to be tilted.

In the most preferred embodiment of the present invention designed especially for Israeli and European cisterns and which has recently undergone tests at the Israel Institute of Standards and been given the highest rating of any such device tested todate in Israel, the entire upwardly extending surface area of said vessel is adapted to be tilted and pivotally displaced from its rest position on the bottom of the cistern in which it is installed whereby there is created an opening for the rapid passage of water under the lower edge of said vessel.

The present invention is also directed to a device incorporating a vessel as described in combination with a mechanism adapted to effect the tilting of said tiltable vessel section, the arrangement being such that upon insertion of said device in said cistern and upon actuation of said flush actuation means said section remains in its rest position and the flushing action mainly utilizes only the water enclosed in the vessel and the water contained in the cistern above the level of said opening at the upper end of the vessel, while upon actuation of said tilting mechanism said section is tilted to form an opening facing more than one wall of the cistern and retained in its open position by said float means until after the completion of the flushing action, whereby the actuation of the flushing mechanism results in the rapid entrance of the water contained in the cistern under the lower edge of said section and out the water outlet of the cistern wherein the inward flow of water from the walls of said cistern towards said water outlet under said edge is multidirectional and substantially all the water contained in the cistern as well as the water enclosed in the vessel is utilized for the flushing action, whereafter said retaining float means are adapted to relese said section from its tilted position to enable its return to its initial closed rest position.

In such a device said tilting mechanism can preferably comprise a lever coupled at one end to a handle and having its other end extending adjacent a tiltable section of said vessel and adapted to push thereagainst and effect the pivotal displacement thereof or a lever coupled at one end to a handle and having its other end provided with a plurality of spaced holes adapted to receive and pull a chain attached to the tiltable section of said vessel.

According to yet another variation of the present invention there is provided a device incorporating a vessel as described in combination with a dual actuating means for the flushing mechanism of the cistern in which the device is installed, which dual actuating means is adapted to replace the regular flush actuating means of said cistern.

The first of said means preferably comprises a mechanism for actuating the flushing mechanism and the second of said actuating means comprises a mechanism adapted to actuate the flushing mechanism and to effect the pivotal displacement of the tiltable section of said vessel the arrangement being such that upon insertion of said device in said cistern and upon actuation of said first flush actuation means said section remains in its rest position and the flushing action mainly utilizes only the water enclosed in the vessel and the water contained in the cistern above the level of said opening at the upper end of the vessel, while upon actuation of said second actuating means said flushing mechanism is activated and said section is tilted to form an opening facing more than one wall of the cistern and said tiltable section is retained in its open position by interaction with said float means until after the completion of the flushing action. This arrangement permits the rapid entrance of the water contained in the cistern under the lower edge of said section and out the water outlet of the cistern whereby substantially all the water contained in the cistern above the lower edge of said tiltable section as well as the water water enclosed in the vessel is utilized for the flushing action, whereafter said retaining means are adapted to automatically release said tiltable section from its open position to enable its return to its initial closed rest position.

In such a device said second actuating means preferably comprises a lever coupled at one end to a handle adapted to actuate the flushing mechanism ahd having its other end extending adjacent a tiltable section of said vessel and adapted to push thereagainst and effect the pivotal displacement thereof and said retaining means preferably comprise two independent but functionally complementary retaining means the first of said retaining means being adapted to effect an initial retention of said section in its tilted position whereupon said retaining float means is then adapted to engage said vessel section and retain it in its open position until after the completion of the flushing action.

In a preferred embodiments of the present invention said float means comprise the float and float lever of the water cistern itself while in another preferred embodiment of the present invention said float means comprises an auxiliary float coupled to a hinged float lever, which float lever is attached at its other end to a support extending from a fixed portion of said vessel. In both cases, however, a portion of said vessel's tiltable section is adapted in its displaced position to intersect the arc ascribed by said water level responsive float means whereby said portion is adapted to be engaged by said float means in its downward arc upon the emptying of the cistern and to be retained in said displaced position during the entire flushing action and until the completion thereof whereafter the rising water in the refilling cistern lifts said float means away from said section and allows said section to automatically return to its initial closed rest position.

In order that the invention may be more fully understood reference should be had to the following illustrative description read in conjunction with the accompanying drawings in which.

With specific reference now to the figures in detail it is stressed that the particulars shown are by way of example and for purposes of illustrative discussion only and are presented in the cause of providing what is believed to be the most useful and readily understood description of the principles and conceptual aspects of the invention. In this regard no attempt is made to show structural details of the system and its apparatus in more detail than is necessary for a fundamental understanding of the invention the description taken with the drawings making apparent to those skilled in the art how the several forms of the invention may be embodied in practice.

Figure 1:
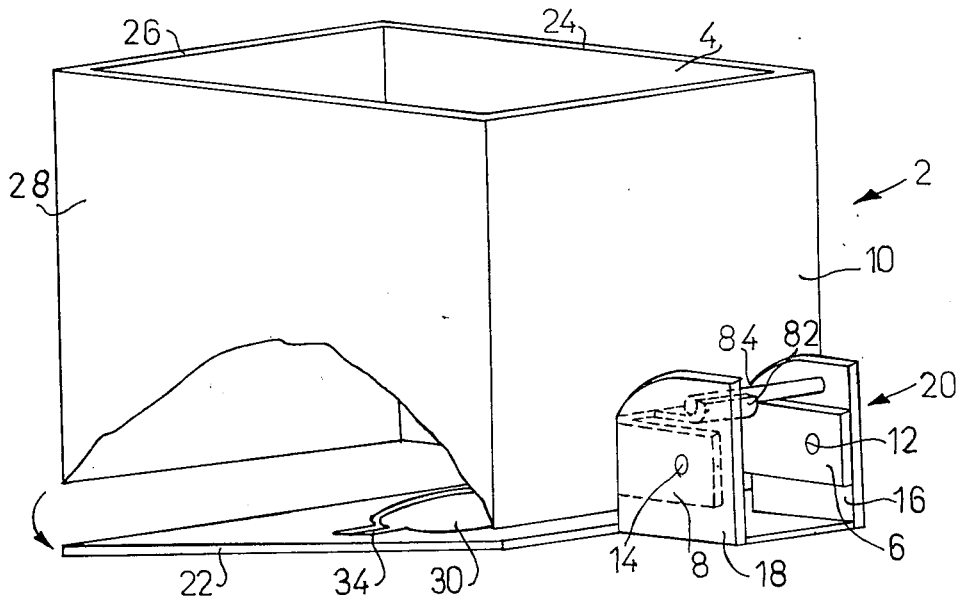
FIG. 1 is a perspective view of a preferred vessel according to the present invention with part of its front wall broken away to disclose features of the bottom thereof.

Referring first to FIG. 1 there is shown a hollow vessel 2 provided with an opening 4 at its upper end for the entry of water therethrough. Said vessel is adapted to be tilted and pivotally displaced from its rest position to the open position shown by virtue of two flanges 6 and 8 extending from a side 10 of said vessel and pivotally attached by short pivot pins 12 and 14 to the walls 16 and 18 of a support base 20 which is shown as an integral part of vessel bottom 22.

The operation of such a vessel will be described hereinafter with reference to FIGS. 4–5 however it should be noted that said vessel in its tilted position forms a multidirectional opening for the rapid passage of water under the lower edges of the sides 24, 26 and 28 of said vessel.

As will be understood the vessel can be a tubular body open at both ends wherein upon insertion of the vessel into the cistern the bottom of the cistern serves as a common bottom to both the vessel and the cistern. This possibility is especially envisioned in the cases in which manufacturers will manufacture cisterns with the devices of the present invention forming an integral part thereof in which case support base 20 would be manufactured as part of the cistern and vessel bottom 22 would be unnecessary.

Alternatively and as can clearly be seen with reference to FIG. 1 said vessel 2 can comprise a hingedly attached bottom surface 22 having a water outlet opening 30 therein. Said water outlet 30 of the vessel is adapted to be of equal or greater area than the opening of the cistern water outlet so as to neither restrict the flow of water therethrough nor restrict the free movement of the valve of the flushing mechanism which it surrounds.

When the vessel is manufactured separately from the cistern it is preferable for said vessel to comprise means for affixing said vessel in said cistern. Thus, for example, since the standard cistern illustrated in FIG. 4 is manufactured with projections 32 extending from the bottom thereof, the vessel shown in FIG. 1 was prepared for attachment therein by the provision of complementary apertures 34 in the bottom of said vessel adapted to engage said projections.

Another possibility is to manufacture a specially designed vessel bottom comprising a downwardly extending connector pipe adapted to tightly fit through the water outlet of said cistern and upwardly extending projections positioned around the water outlet opening of said bottom and adapted to engage and support the bottom of an air-bell flush mechanism provided in said cistern.

While not shown, such a multipurpose bottom should provide many advantages including a saving in component parts to manufactures wishing to produce cisterns already incorporating devices according to the present invention.

Figure 2:
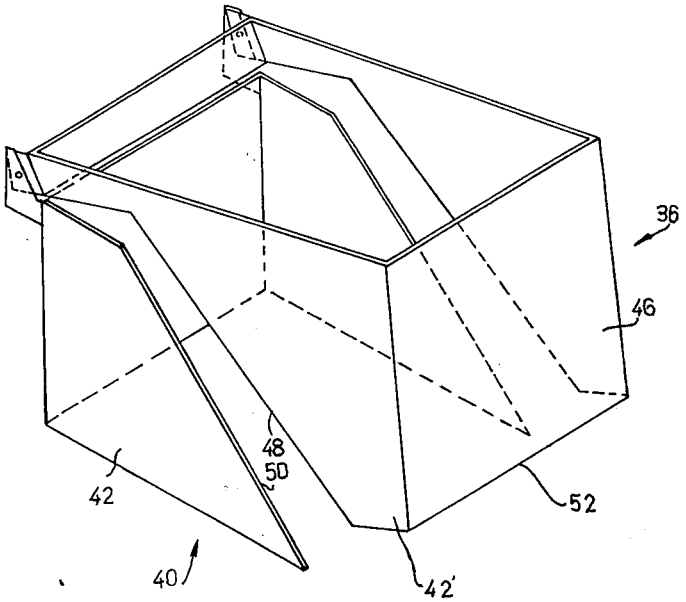
FIGS. 2 and 3 are perspective views of different vessels according to the present invention.
Figure 3:
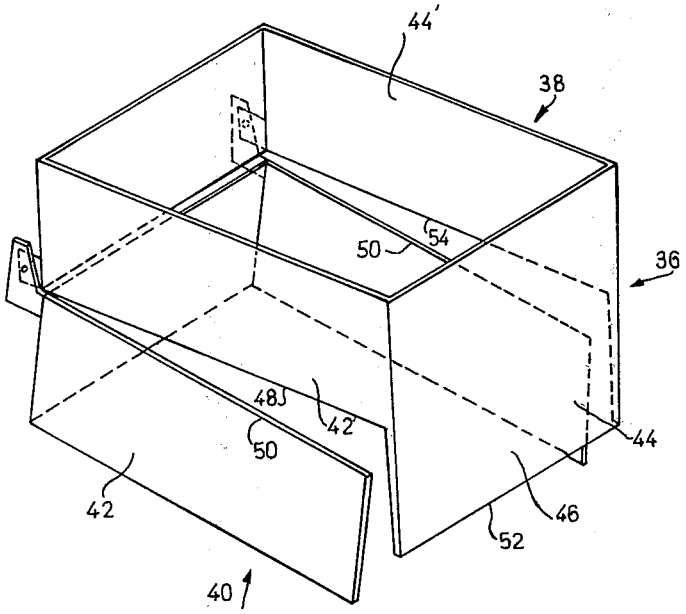

Referring now to FIGS. 2 and 3 there are shown further embodiments of the device according to the present invention which embodiments can be recognized as functional equivalents of the vessel illustrated in FIG. 1 the difference being merely in the amount of upwardly extending surface area of said vessel adapted to be tilted.

While it has been found to be most advantageous to tilt the entire vessel to achieve a maximizing of the extent of the multidirectional opening created for the rapid passage of water therethrough, tilting of smaller areas of upwardly extending surfaces of the vessel also achieve satisfactory and acceptable results.

Thus, in referring for example to the preferred type of vessel having rectangular cross-section one could characterize such vessels as those wherein at least one upwardly extending side of said vessel as well as at least a section of an additional side of said vessel are adapted to be tilted and in combination to form a multidirectional opening for the rapid passage of water, into the area initially enveloped by said vessel, upon the tilting thereof.

Especially preferred are vessels wherein at least one upwardly extending side of said vessel and at least a section of two additional sides of said vessel are adapted to be simultaneously tilted and in combination to form a multidirectional opening as described hereinafter with reference to illustrative FIGS. 2 and 3.

Referring first to FIG. 2 there is shown a vessel designated by general reference number 36 having a substantially rectangular cross-section and substantially diagonally divided into an upper 38 and lower 40 hingedly connected portion wherein said lower portion 38 is comprised of at least sections of two sides 42 and 44 of said vessel and said upper portion is comprised of at least minor sections of at least three sides of said vessel and preferably comprised of at least a major section of one side 46 of said vessel and at least minor sections of at least two additional sides 42', 44' of said vessel wherein parts 48 and 54 of the lower edge of said upper portion are adapted in the closed rest position of said vessel to rest on a complementary upper edge 50 of said lower portion and wherein said upper portion of said vessel is adapted to be tilted and pivotally displaced from its rest position whereby there is formed a multidirectional opening for the rapid passage of water under the lower edge 48, 52, 54 of said tiltable upper portion.

The above description is equally applicable to the vessel illustrated in FIG. 3 wherein like reference numerals have been used and which differs from the vessel illustrated in FIG. 2 only in that the vessel has been horizontally divided into two portions with side 46 formed as a part of upper portion 38 whose other sides 42 and 44' do not extend to the bottom of the vessel. Of course further variations in the division of the vessel are also possible and included in the present invention.

Figure 4:
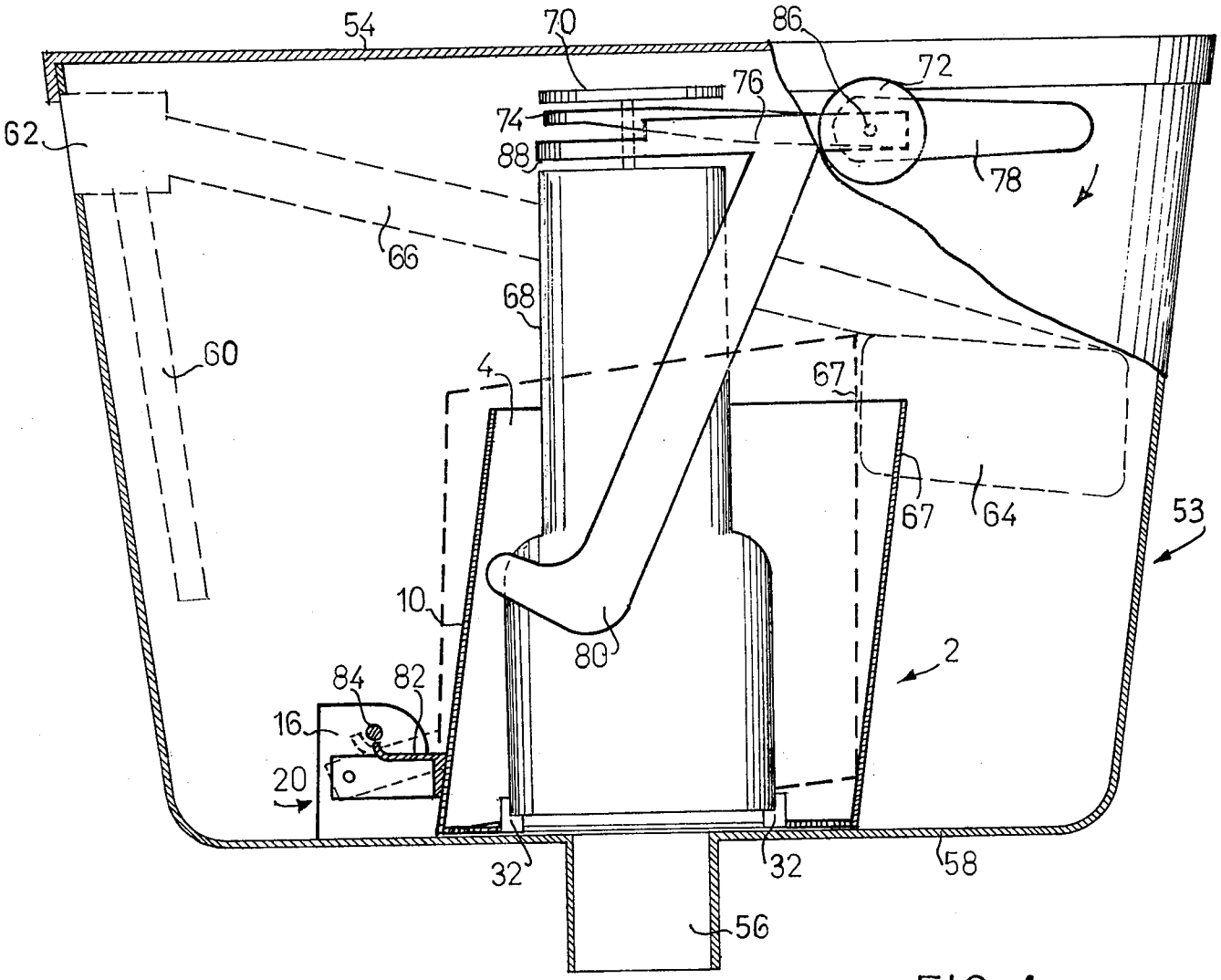
FIG. 4 is a sectional view of a standard air bell valve operated cistern into which a vessel as shown in FIG. 1 and a preferred type of tilting and retention means have been incorporated.

Referring now to FIG. 4 in said figure the reference number 53 designates a standard cistern of a toilet which is covered at the top by a detachable lid 54 and which has a water outlet 56 in its bottom 58. The cistern includes an inlet (not shown) whose outflow into the cistern through depending pipe 60 is controlled by a valve mechanism 62. When outlet 56 is closed the water flowing into the cistern reaches a level predetermined by a float 64 attached to the end of a lever arm 66 which controls the opening and closing of valve mechanism 62. As is known in normal operation of such cisterns when the float 64 at the end of lever arm 66 reaches a predetermined level, the arm closes valve mechanism 62 and the flow of water into the cistern terminates leaving the cistern filled with water up to said predetermined level. In the cistern shown the flushing mechanism comprises a standard air-bell valve 68 seated over said water outlet 56 and having an actuating head 70 adapted to be lifted. When the toilet is to be flushed the outlet 56 is opening thereby permitting the water in the cistern to rush into the toilet bowl (not shown) and to flush waste material contained therein. After substantially all the water has drained from the cistern the vacuum which was created, between the two inverted cups which form the air-bell, upon the lifting of the actuating head 70, is broken by the entrance of air and the valve thereof automatically reseates itself over outlet 56. In the interim the cistern already begins to fill up again with water because descent of the float 64 has meanwhile opened the water supply valve 62. In such a cistern there can be provided, as shown a device according to the present invention comprising a hollow vessel 2 inserted into the flushing cistern 53 and adapted to at least partially surround the flushing mechanism 68 and water outlet 56 thereof. Said vessel is provided with an opening 4 at its upper end for the entry of water therethrough and is adapted to be tilted and pivotally displaced as shown in broken lines from its rest position to form a multidirectional opening for the rapid passage of water under the lower edges of the sides 26 and 28 (not shown) and side 24 of said vessel.

In the preferred device illustrated there is provided in combination with the vessel already described a dual actuating means for the flushing mechanism which dual actuating means replaces the regular flush actuating means of said cistern. In the illustrated embodiment the first of said means comprises a mechanism for actuating the flushing mechanism as standardly found in such cisterns comprising a flushing knob 72 linked to a flushing lever 74 adapted to lift the actuating head 70 of the air-bell valve.

The second of said actuating means comprises a mechanism adapted to actuate the flushing mechanism and to effect the pivotal displacement of the tiltable section of said vessel, which in the embodiment illustrated constitutes the entire vessel, said mechanism comprising a lever 76 coupled at one end to flushing handle 78 and having its other end 80 extending adjacent a tiltable section of said vessel and adapted to push thereagainst and effect the pivotal displacement thereof.

The vessel of the present invention once installed in a cistern as illustrated can be adapted to interact with one or more retaining means adapted to retain the tiltable section of the vessel in its tilted open position until after the completion of the flushing action.

In the embodiment shown said retaining means in fact comprise two independant, but functionally complementary, retaining means. The first of said retaining means comprises hook 82 extending from side 10 of vessel 2 which is adapted to initially engage pin 84 extending between walls 16 and 18 of support base 20 (better seen with reference to FIG. 1) when the vessel is first tilted. This retention means is sufficient for initial retention because of the lifting effect of the water in the cistern on the tilted vessel before a substantial amount of water has emptied from the vessel. As the water level in the cistern goes down, however, the increasing relative weight of the vessel is adapted to cause resilient hook 82 to disengage from pin 84. Even before said disengagement takes place, however, float 64 is adapted to function as said second retention means and is adapted in its downward arc upon the emptying of the cistern to engage a tilted vessel section and retain it in its tilted position as shown until the rising water in the refilling cistern lifts said float away from said section and allows said section to automatically return to its initial closed rest position.

In practice when flushing handle 78 is pulled in the direction of the arrow, lever 76 pivots around pivot point 86 and a section 88 of said lever serves to lift the actuating head 70 of the air bell valve while the end 80 of said lever moves to give the vessel 2 (or the tiltable section thereof) a sufficient kick to dislodge it from its rest position and thereby creates a multidirectional opening for the rapid passage of water thereunder.

Referring to the above description with reference to FIG. 4 it will now be understood that the arrangement of the device is such that upon insertion of said device in said cistern and upon actuation of said first flush actuation means 72, 74 said vessel remains in its rest position and the flushing action mainly utilizes only the water enclosed in the vessel and the water contained in the cistern above the level of said opening 4 at the upper end of the vessel, while upon actuation of said second actuating means 78,76,88 and 80 said vessel is tilted and retained in its open position first by retaining means 82,84 and then by retaining means 64 until after the completion of the flushing action, thereby allowing the rapid entrance of the water contained in the cistern under the lower edges of said vessel and out the water outlet of the cistern and substantially all the water contained in the cistern as well as the water enclosed in the vessel is utilized for the flushing action, whereafter said retaining means 64 are adapted to automatically release said vessel from its open position to enable its return to its initial closed rest position.

It is to be noted that the function of the float as preferred retention means in the present embodiment is diametrically opposite from its use in prior art patents wherein the descent of the float during the flushing operation resulted in the closing of the openable port since in the present invention it is the ascent of the float after the flushing action has ceased and the cistern has begun to refill which results in the closing of the opening created when the vessel or a section thereof is tilted.

It is worthwhile to note that the device as described with reference to the preferred embodiment illustrated in FIG. 4 was submitted for testing to the Israel Institute of Standards. Among the exceptional results achieved by the device according to present invention was the fact that in a set of ten complete flushes and a set of ten partial flushes the deviation in the amount of water discharged in each set was less than 0.1 liter while the Israel standard for allowable deviation is ±0.5 liter.

Similarly while the Israel standard requires a minimum discharge rate of 1.5 liter per sec. during the emptying of the initial 80% of water in the cistern the tilted vessel allowed a measured discharge rate of 1.67 liter per sec.

For these and other reasons the device according to the present invention constitutes a major advance over prior art devices in reliability, simplicity and operation performance.

As stated hereinbefore devices of the present invention, with minor variations dictated by the existing flushing mechanism and structure of the cistern in which they are to be installed, can be adapted for installation in almost all types of existing flushing cisterns.

Thus, for example, a device according to the present invention could be adapted to operate in conjunction with a siphonic cistern of the type required for use in England and partially in use in Israel, by placing the vessel of the present device around the intake or inlet of the siphon in which case the term flushing mechanism and water outlet of the cistern as used herein is intended to refer to said siphon inlet.

Similarly the term partially surround as used herein with reference to the vessels of the present invention is intended to denote that the vessel does not have to, and in fact doesn't, extend all the way up to the full height of an upright flushing mechanism which it surrounds, such as an air bell or suction cupvalve mechanism; need not completely surround a convoluted and horizontally extending flushing mechanism such as a siphon; and in fact can be a slotted vessel and therefor by definition not completely circumferentially surround the flushing mechanism.

Furthermore the vessel utilized in the devices of the present invention may be made of any material, although plastic is preferred and its superficies may be a cylinder of elliptical cross-section a truncated cone, a prism of square or rectangular cross-section or any other hollow gemetrical shape as well as incomplete geometric shapes such as slotted hollow tubes although for ease of manufacture vessels of substantially rectangular cross-section as already described are preferred.

As will be realized the actuating mechanism and retention means described with reference to the preferred embodiment illustrated in FIG. 4 are not the only means useable with devices according to the present invention and variations thereof will now be described with reference to FIGS. 5 and 6.

Figure 5:
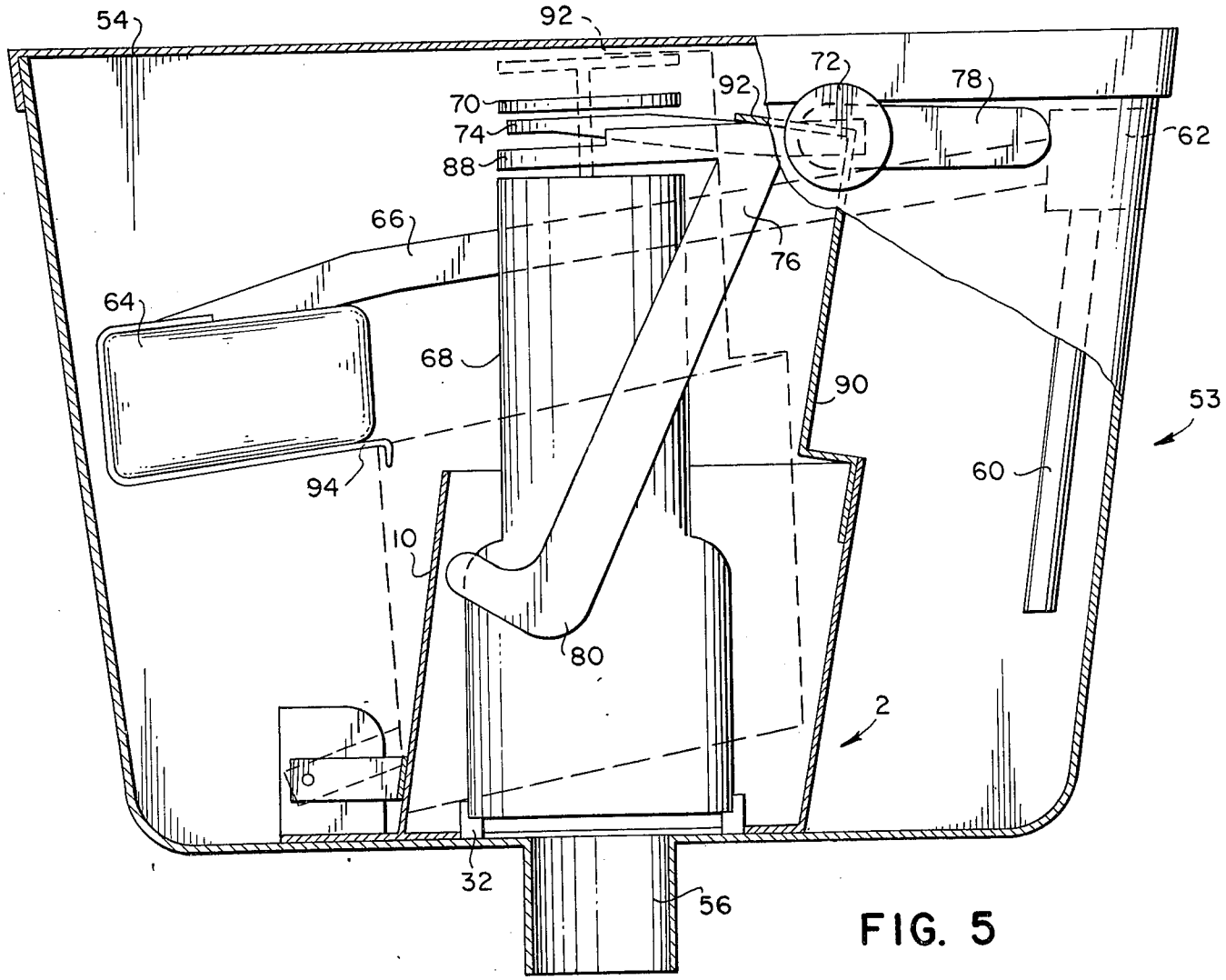
FIG. 5 is a sectional view of a standard air bell valve operated cistern into which a vessel as shown in FIG. 1 and a different preferred type of tilting and retention means have been incorporated.

Referring now to FIG. 5 there is illustrated a device according to the present invention installed in a standard cistern of the type described with reference to FIG. 4 and like numbers have been used to refer to like parts already discussed with reference to said previous Figure. It is to be noted that while in the cistern described in FIG. 4 the water inlet and valve mechanism 62 were situated to the left of the cistern with the float lever 66 and float 64 extending to the right, the presently described device is adapted for insertion in standard cisterns wherein the water inlet and valve mechanism 62 are situated to the right of the cistern with the float lever 66 and float 64 extending to the left.

In effect the only difference between the present embodiment and the one previously described is with regard to the retaining means which are specifically adapted for use with air-bell type flush mechanism and a cistern having a right-handed water inlet.

Referring to FIG. 5 it can be seen that said first retaining means comprises at least one arm 90 extending upwardly from said vessel and having a flange 92 depending therefrom extending in the direction of said air bell and adapted upon the pivoting of said tiltable section to pivot therewith and extend into the space between the actuating head 70 of the air-bell and the lid 54 of the cistern. The arrangement is such that upon the lifting of the actuating head 70 which in fact takes place after the tilting of vessel 2, since in practice leg 80 of lever 76 displaces the tiltable section of said vessel before section 88 of said lever has traversed the distance necessary to lift actuating head 70, said head 70 is adapted to press against said flange 92 thereby initially forcing said tilted vessel section to remain in its open position.

Furthermore as shown in the present embodiment said float lever 66 is provided with a hook 94 positioned so as to be adapted, during the downward arc ascribed by the float 64 upon the emptying of the cistern during the flushing action, to engage the upper lip of tilted wall 10 of said vessel and to retain it in its tilted position, as shown, until the rising water in the refilling cistern lifts said float away from said section and allows said section to automatically return to its initial closed rest position. With reference to the embodiment which will be described hereinafter in greater detail with specific reference to FIG. 6, the device described constitutes an embodiment specifically designed for large capacity US-type cisterns in which a high volume flush using all the water in the cistern is undesirable and unnecessary even for flushing solid wastes.

Consequently it is intended and envisioned that devices according to the present invention can be adapted to be attached atop, and be shaped as to form a contiguous outer surface with the outer surface of, a first sleeve-like, vessel of oval, polygonal or any of the shapes described in U.S. Pat. No. 3,259,918 and described or mentioned in U.S. Pat. No. 3 732,577, wherein said prior art sleeve, which has already been installed in hundreds of thousands of cisterns in the U.S., continues to serve its intended function of forming an open ended water column extending upward around the valve assembly thereby preventing water stored in the base of the cistern outside the column from being discharged during flushing, while the device according to the present invention is adapted in its position atop said first sleeve to selectively allow both low volume and high volume flushes drawing substantially only from the water within said first sleeve and the water above the upper edge thereof.

Alternatively for U.S. type cisterns in which such sleeves have not yet been installed it is intended and envisioned that devices according to the present invention will be manufactured as a composite two-tiered vessel similar to those shown with reference to FIGS. 2 and 3. Said devices however will be adapted for large volume cisterns by comprising a lower tubular sleeve adapted to be connected to the bottom of said cistern to form a fixed open ended water column extending above and around the water outlet thereby preventing water stored in the base of the tank outside the column from being discharged during flushing and further comprising an upper hingedly connected tubular sleeve wherein the lower edge of said upper sleeve portion is adapted in the closed rest position of said vessel to rest on a complementary upper edge of said lower sleeve portion for low-volume flushes and wherein at least a section of said upper sleeve portion of said vessel is adapted to be tilted and pivotally displaced from its rest position whereby there is formed a multidirectional opening for the rapid passage of water under the lower edges of said tiltable section for high volume flushes.

Figure 6:
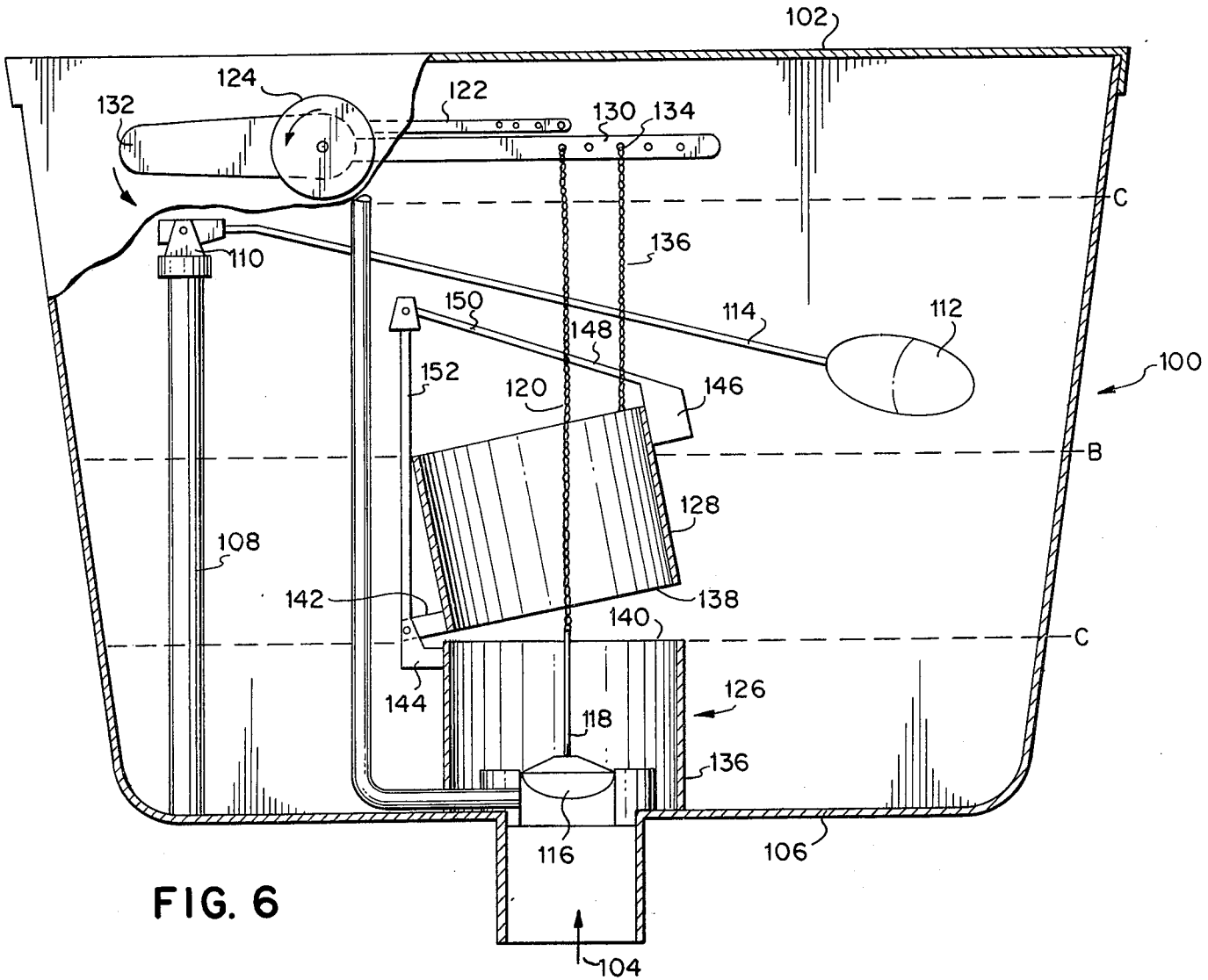
FIG. 6 is a sectional view of a standard US type flush-ball valve operated cistern into which a vessel according to the present invention has been incorporated.

Referring now to FIG. 6 the reference member 100 designates a standard U.S. type cistern of a toilet which is covered at the top by detachable lid 102 and which has a water outlet 104 in its bottom 106. The cistern includes an inlet pipe 108 which conveys water into the cistern and supports an inlet valve 110. When outlet 104 is closed the water flowing into the cistern reaches a level predetermined by float 112 attached to the end of lever arm 114 which controls the opening and closing of valve 110. In the cistern shown the flushing mechanism comprises a simple flush ball valve 116 seated over said water outlet 104 and having a depending vertical stem 118 connected by a chain 120 to flushing lever 122.

As with the other preferred embodiments of the present invention there is provided a dual actuating means for the flushing mechanism which dual actuating means replaces the regular flush actuating means of said cistern. In the illustrated embodiment the first of said means comprises a mechanism for actuating the flushing mechanism as standardly found in such cisterns comprising a flushing knob 124 linked to flushing lever 122 which lever is adapted to pull and lift chain 120 of the flush ball valve 116.

The second of said actuating means comprises a mechanism adapted to actuate the flushing mechanism and to effect the pivotal displacement of the tiltable section of the double tier vessel 126, said mechanism comprising a lever 130 coupled at one end to flushing handle 132 and having its other end 134 extending above a tiltable section of said vessel and attached thereto by means of a chain 136 to effect the pivotal displacement thereof.

While in the embodiment shown the tiltable section of the two-tiered vessel 126 comprises an entire tubular sleeve-like section 128 similar to the hollow vessel 2 illustrated with reference to FIG. 2 it will be realized that in manufacturing entire two-sectional vessels for installation in, or as part of, U.S. type cisterns it is also possible to divide the tiltable and non-tiltable section of the vessel in a different manner, e.g., by forming a composite bottom of bottom portion 136 from FIG. 6 and bottom portion 40 from FIG. 2 or 3 and having an upper tiltable section similar to sections 38 shown in FIGS. 2 and 3.

Returning now to the operation of the device illustrated in FIG. 6 said lever 130 is also situated below lever 122 and is adapted upon actuation and displacement to push against the lift said flushing lever 122 thereby actuating the flushing mechanism.

Referring now to the vessel 126 itself, there is shown a two-tiered vessel 126 having a substantially oval or oblong cross section and substantially horizontally divided into upper 128 and lower 136 hingedly connected tubular portions wherein said lower portion is an oval sleeve-like barrier adapted to be fixedly attached to the bottom 106 of said cistern to form an open-ended water column extending upward around the valve 118 assembly thereby preventing the water stored in the base of the cistern below level A from being discharged during flushing. As described hereinbefore said upper portion 128 is adapted to assume a first normally closed rest position (not shown) in which rest position said upper portion 128 forms a contiguous outer surface with that of the lower portion 136 with the lower edge 138 of said upper sleeve portion resting on the complementary upper edge 140 of said lower sleeve portion for low flushes which will substantially utilize only the water in the cistern between levels B and C and the water within said upper 126 and lower portion 136.

Said upper portion 126 is adapted to be tilted and pivotally displaced from its rest position to the open position shown upon the pulling of chain 136 by virtue of flanges 142 extending from the lower sides of said upper portion and pivotally attached to support brackets 144 (one shown and one not shown) which in turn extend from the top of lower portion 136. As is realized when said upper portion 126 is tilted the actuation of the flushing mechanism 122, 120, 118 results in a high volume flush utilizing substantially all the water in the cistern between levels A and C as well as the water within lower sleeve portion 136. It is to be noted that the embodiment shown can be considered as illustrating a two-tiered vessel manufactured as a single unit and can also be viewed as illustrating the arrangement wherein upper vessel 126 is affixed atop existing sleeve 136 to form the two tiered vessel in which case it is a simple manner to adapt said upper vessel 126 for attachment to said lower sleeve by providing brackets 144 with clamping means adapted to slide over the back upper edge 138 of sleeve 136 to securely affix said upper vessel 126 to said lower sleeve.

As stated, it is preferably that a portion of the tiltable section be adapted in its displaced position to intersect the arc ascribed by the water level responsive float and float lever of the water cistern itself and be retained thereby. When, however, the physical construction of the cistern and its float do not lend themselves to such use even by the attachment of extension hooks or floats to the cistern float lever as is also possible and preferred, then it is possible to provide separate float means especially adapted for the purpose of engaging and retaining said tiltable section.

While said auxiliary float means can be attached to the wall of the cistern or to one of its fixed parts, it is possible, as in the embodiment shown, to make said float means integral with the device wherein said float means will comprise a float 146 coupled to a hinged float lever 148 which float lever is hingedly attached at its other end 150 to a support 152 extending from a fixed portion 144 of the vessel 126.

While particular preferred embodiments of the invention have been described and shown in the drawings, it will be evident to those skilled in the art that the present invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A device for converting a single volume cistern into a selective volume cistern adapted to selectively allow both low-volume and high-volume flushes wherein said single volume cistern is of the type having a water inlet, a water outlet, a water level responsive means for controlling the amount of water flowing into the cistern including a valve mechanism operationally linked thereto, a flush actuating means and a flushing mechanism operationally linked to said water outlet, said device comprising a hollow vessel provided with an opening at its upper end for the entry of water therethrough and being adapted to be inserted into the flushing cistern in a first normally closed rest position which surrounds the flushing mechanism and forms an open ended water column extending above and around said water outlet to exclude a portion of the water in said cistern from passing through said water outlet while said vessel is in said first position for low volume flushes, and wherein at least a section of the upwardly extending surface area of said vessel is adapted to be tilted and pivotally displaced from said first rest position to a second displaced open-position to form a multidirectional opening for the rapid passage of water under the lower edge of said tiltable section, and a water level responsive float means which in movement ascribes an arc; a portion of said tiltable section in its displaced position intersecting the arc ascribed by said water level responsive float means and being engaged by said float means in its downward arc upon the emptying of the cistern and being retained in said displaced position during the entire flushing section and until the completion thereof whereafter the rising water in the refilling cistern lifts said float means away from said section and allows said section to automatically return to its initial closed rest position.

2. A device according to claim 1 wherein at least a quarter of the upwardly extending surface area of said vessel is adapted to be tilted.

3. A device according to claim 1 wherein said vessel has a substantially rectangular cross-section and wherein at least one upwardly extending side of said vessel and at least a section of two additional sides of said vessel are adapted to be simultaneously tilted and in combination to form a multidirectional opening for the rapid passage of water into the area initially enveloped by said vessel upon the tilting.

4. A device according to claim 1 wherein said vessel has a substantially rectangular cross-section and is divided into upper and lower hingedly connected portions wherein said lower portion is comprised of at least sections of two sides of said vessel and said upper portion is comprised of at least minor sections of at least three sides of said vessel wherein a part of the lower edge of said upper portion is adapted in the closed rest position of said vessel to rest on a complementary upper edge of said lower portion and wherein said upper portion of said vessel is adapted to be tilted and pivotally displaced from its rest position whereby there is formed a multidirectional opening for the rapid passage of water under the lower edges of said tiltable upper portion.

5. A device according to claim 4 wherein said vessel has a substantially rectangular cross-section and is divided into upper and lower hingedly connected portions wherein said lower portion is comprised of at least sections of two sides of said vessel and said upper portion is comprised of at least a major section of one side of said vessel and at least minor sections of at least two additional sides of said vessel.

6. A device according to claim 1 wherein said vessel comprises a lower sleeve adapted to be connected to the bottom of said cistern to form said open ended water column extending above and around said water outlet and an upper hingedly connected sleeve wherein the lower edge of said upper sleeve portion is adapted in the closed rest position of said vessel to rest on a complementary upper edge of said lower sleeve portion for low volume flushes and wherein at least a section of said upper sleeve portion of said vessel is adapted to be tilted and pivotally displaced from its rest position.

7. A device according to claim 1 characterized in that upon insertion of the vessel into the cistern the bottom of the cistern serves as a common bottom to both the vessel and the cistern.

8. A device according to claim 1 further comprising a dual actuating means for said flushing mechanism adapted to replace the regular flush actuating means of said cistern wherein the first of said dual means comprises a mechanism for actuating the flushing mechanism and the second of said dual actuating means comprises a mechanism adapted to actuate the flushing mechanism and to effect the pivotal displacement of the tiltable section of said vessel; the arrangement being such that upon insertion of said device in said cistern and upon actuation of said first actuating means, said section remains in its rest position and the flushing action mainly utilizes only the water enclosed in the vessel and the water contained in the cistern above the level of said opening at the upper end of the vessel, while upon actuation of said second actuating means said flushing mechanism is activated and said section is tilted to form an opening facing more than one wall of the cistern and said tiltable section is retained in its open position by interaction with said float means until after the completion of the flushing action, thereby allowing the rapid entrance of the water contained in the cistern under the lower edge of said section and out the water outlet of the cistern, whereby substantially all the water contained in the cistern above the lower edge of said tiltable section as well as the water enclosed in the vessel is utilized for the flushing action.

9. A device according to claim 8 wherein said second actuating means comprises a lever coupled at one end to a handle adapted to actuate the flushing mechanism and having its other end extending adjacent a tiltable section of said vessel and adapted to push thereagainst and effect the pivotal displacement thereof.

10. A device according to claim 8 further comprising a first retaining means adapted to effect an initial retention of said section in its tilted position whereupon said tilted section is adapted to be engaged by said float means and to be retained in its open position until after the completion of the flushing action.

11. A device according to claim 1 wherein said float means comprise a float and a float lever, said float being coupled to said float lever, which float lever is hignedly attached at its other end to a support extending from a fixed portion of said vessel.

12. A device according to claim 1 wherein said means for controlling the amount of water flowing into the cistern comprises said float means; said float means comprises a float and a float lever, said float being coupled to said float lever; and said tiltable portion is adapted to be engaged by said float in its downward arc upon the emptying of the cistern and to be retained in said displaced position until the rising water in the refilling cistern lifts said float away from said section and allows said section to automatically return to its initial closed rest position.

13. A device according to claim 1 wherein said float means comprise a float lever, a float and a hook, said float lever being provided with said hook positioned so as to be adapted during the downward arc ascribed by the float coupled to said float lever upon the emptying of the cistern during the flushing action to engage said section and retain it in its tilted position until the rising water in the refilling cistern lifts said float means away from said section and allows said section to automatically return to its initial closed rest position.

14. A device according to claim 1 wherein said vessel further comprises means adapted for affixing said vessel in said cistern.

15. A device according to claim 14 wherein said means comprise apertures in the bottom of said vessel adapted to engage projections extending from the bottom of said cistern.

16. A device according to claim 1 wherein said single volume cistern comprises a first sleeve-like vessel affixed to the bottom thereof forming an open-ended water column around the water outlet of said cistern wherein said device is adapted to be attached atop said first sleeve-like vessel and in its closed rest position to form a contiguous outer surface with that of said first sleeve-like vessel whereby said device is adapted to selectively allow both low volume and high volume flushes drawing substantially only from the water within said first vessel and the water above the upper edge of said first vessel.

* * * * *